US010942467B1

(12) United States Patent
Kikuchi

(10) Patent No.: US 10,942,467 B1
(45) Date of Patent: Mar. 9, 2021

(54) CHARGING DEVICE, IMAGE CARRYING UNIT, AND IMAGE FORMING APPARATUS

(71) Applicant: FUJI XEROX CO., LTD., Tokyo (JP)

(72) Inventor: Yuji Kikuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/773,237

(22) Filed: Jan. 27, 2020

(30) Foreign Application Priority Data

Sep. 18, 2019 (JP) ..... JP2019-169534

(51) Int. Cl.
*G03G 15/02* (2006.01)

(52) U.S. Cl.
CPC ..... *G03G 15/0258* (2013.01)

(58) Field of Classification Search
CPC ..... G03G 15/0225; G03G 15/0258; G03G 15/0291; G03G 21/0035; G03G 2215/02
USPC .... 399/91, 98–100, 107, 110, 111, 115, 123, 399/343, 345, 357
See application file for complete search history.

(56) References Cited

U.S. PATENT DOCUMENTS 5,845,178 A * 12/1998 Hazama ..... G03G 21/0035 399/170
8,369,747 B2 * 2/2013 Ueji ..... G03G 15/0258 399/100
2005/0285036 A1 12/2005 Sato et al.
2007/0230997 A1 10/2007 Matsui

FOREIGN PATENT DOCUMENTS

JP 2006-012664 A 1/2006
JP 2007-271759 A 10/2007

* cited by examiner

*Primary Examiner* — Hoan H Tran
(74) *Attorney, Agent, or Firm* — Sughrue Mion, PLLC

(57) ABSTRACT

A charging device includes a charger, a cleaner, and a separator. The charger is configured to charge an image holding unit. The cleaner is configured to clean the charger. The separator is configured, when the charging device has not yet been used, to separate the charger from the image holding unit and separate the cleaner from the charger.

6 Claims, 12 Drawing Sheets

CHARGING DEVICE, IMAGE CARRYING UNIT, AND IMAGE FORMING APPARATUS

CROSS-REFERENCE TO RELATED APPLICATION(S)

This application is based on and claims priority under 35 USC 119 from Japanese Patent Application No. 2019-169534 filed on Sep. 18, 2019.

BACKGROUND

(i) Technical Field

The present disclosure relates to a charging device, an image carrying unit, and an image forming apparatus.

(ii) Related Art

In the related art, an image forming apparatus includes a charging roller that is in contact with a surface of a photoconductor drum and charges the surface of the photoconductor drum, and a cleaning roller that cleans a surface of the charging roller.

When the charging roller is pressed against the photoconductor drum for a long period of time during storage in such an image forming apparatus, the surface of the charging roller may be deformed. For example, JP-A-2007-271759 discloses a technique of preventing occurrence of uneven charging due to such deformation of the surface of the charging roller.

JP-A-2007-271759 discloses a device including a separating cover. The separating cover includes a cover portion and a hook portion. A protrusion of the cover portion is engaged with a main body frame of an image carrying unit, and the cover portion is rotated toward the charging roller. Thereby, the charging portion covers the charging roller. The hook portion is provided on the cover portion. When the cover portion is rotated toward the charging roller, the hook portion is inserted between the charging roller and the image carrier, is separated from the image carrier, and is locked.

SUMMARY

Aspects of non-limiting embodiments of the present disclosure relate to preventing occurrence of uneven charging due to deformation of a cleaner, as compared with a case where a cleaner is in contact with a charger when a charging device has not yet been used.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a charging device includes a charger, a cleaner, and a separator. The charger is configured to charge an image holding unit. The cleaner is configured to clean the charger. The separator is configured, when the charging device has not yet been used, to separate the charger from the image holding unit and separate the cleaner from the charger.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described with reference to the drawings.

First Exemplary Embodiment

Figure 1:
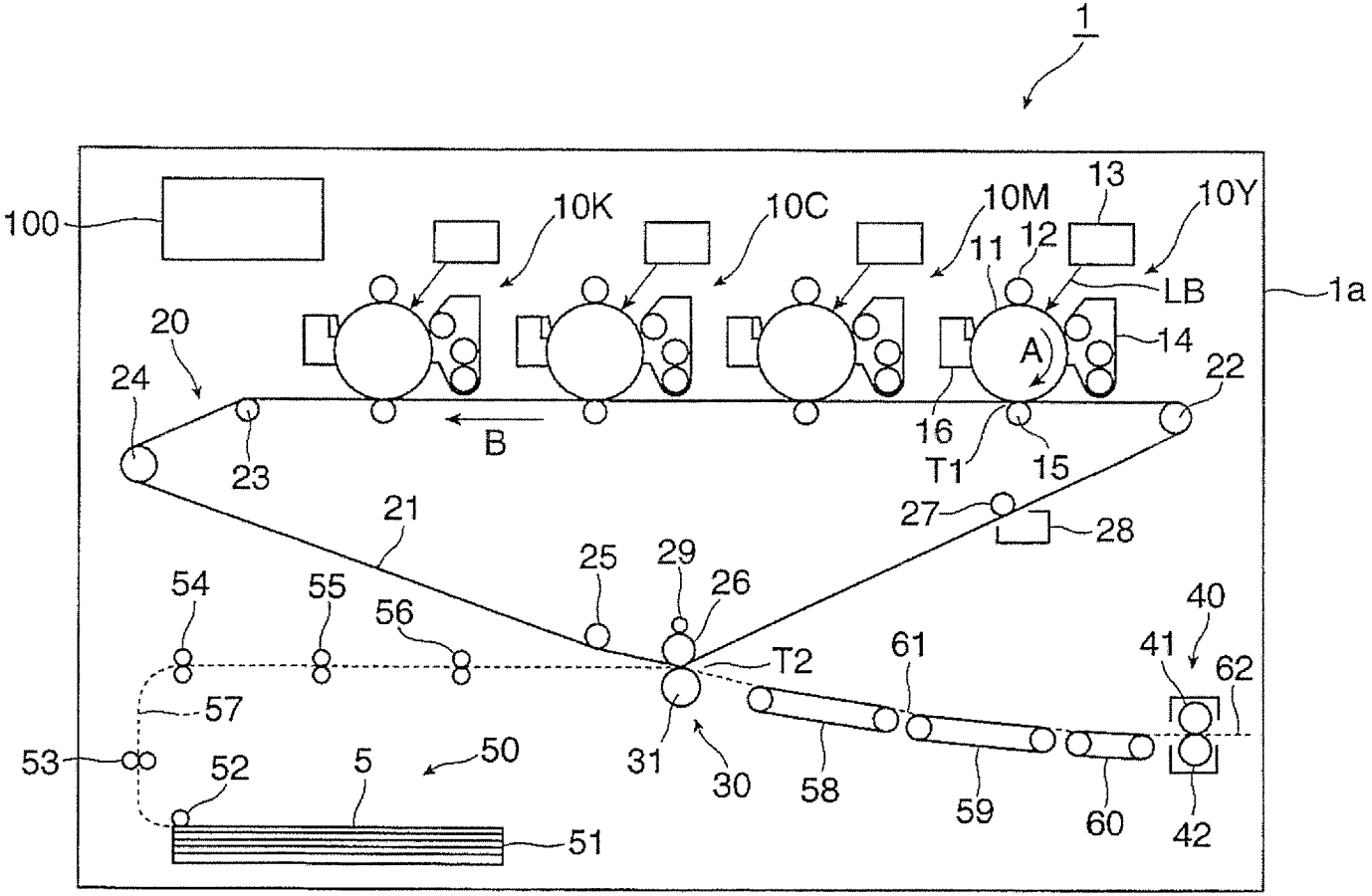
FIG. 1 is a schematic configuration view illustrating an image forming apparatus including a charging device and an image carrying unit according to a first exemplary embodiment of the present disclosure.
Figure 2:
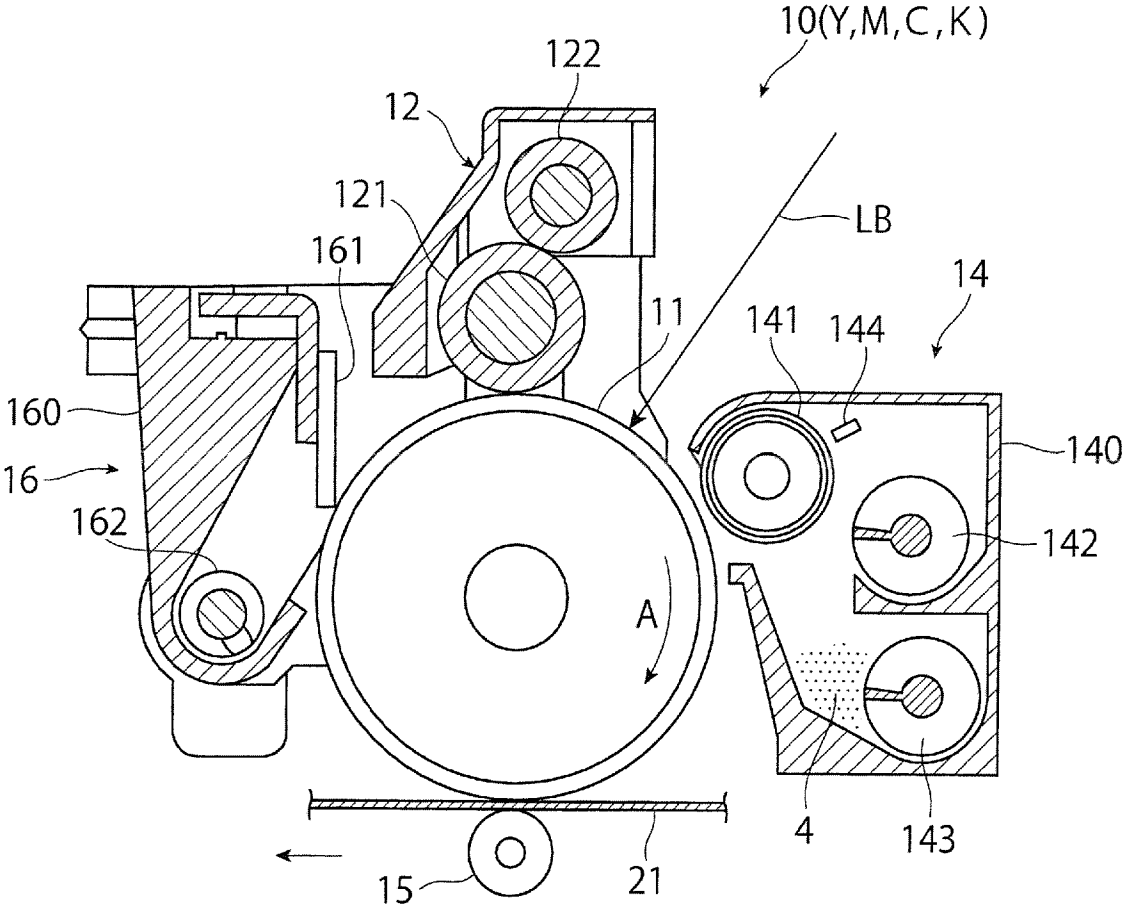
FIG. 2 is a schematic configuration view showing an image forming device of the image forming apparatus according to the first exemplary embodiment of the present disclosure.

FIGS. 1 and 2 illustrate an image forming apparatus including a charging device and an image carrying unit according to a first exemplary embodiment. FIG. 1 illustrates an outline of an overall image forming apparatus. FIG. 2 illustrates a part of the image forming apparatus (an image forming device and the like) in an enlarged manner.

Overall Configuration of Image Forming Apparatus

An image forming apparatus 1 according to the first exemplary embodiment is implemented as, for example, a color printer. The image forming apparatus 1 includes: image forming devices 10 as an example of plural image forming units that each form a toner image to be developed with a toner constituting a developer; an intermediate transfer device 20 as an example of a transfer unit that holds the toner images formed by each image forming devices 10 and finally transfers the toner images to a secondary transfer position T2 for secondary transfer to a recording sheet 5 as an example of a recording medium; a sheet feeding device 50 that accommodates and transports the recording sheet 5 to be supplied to the secondary transfer position T2 of the intermediate transfer device 20; and a fixing device 40 that fixes the toner images on the recording sheet 5 secondarily transferred by the intermediate transfer device 20. In FIG. 1, reference numeral 1*a* indicates an apparatus main body of the image forming apparatus 1. The apparatus main body 1*a* includes a support structure member and an exterior cover. A broken line in the figure indicates a main transport path on which the recording sheet 5 is transported in the apparatus main body 1*a*.

The image forming device 10 includes four image forming devices 10Y, 10M, 10C, and 10K that individually form toner images of four colors of yellow (Y), magenta (M), cyan (C), and black (K). The four image forming devices 10 (Y, M, C, K) are disposed in a row along a horizontal direction in an internal space of the apparatus main body 1*a*.

As shown in FIGS. 1 and 2, each image forming device 10 (Y, M, C, K) includes a photoconductor drum 11 as an example of a rotating image holding unit. The following devices are disposed around the photoconductor drum 11. That is, the devices include a charging device 12 according to the first exemplary embodiment that charges a peripheral surface (an image holding surface) of the photoconductor drum 11 on which an image can be formed to a predetermined potential, an exposure device 13 as an example of an electrostatic latent image forming unit that forms an electrostatic latent image having a potential difference (for each color) by irradiating the charged peripheral surface of the photoconductor drum 11 with light based on image information (a signal), a developing device 14 (Y, M, C, K) as an example of a developing unit that develops the electrostatic latent image with toner of corresponding color (Y, M, C, K) developer to form a toner image, a primary transfer device 15 as an example of a primary transfer unit that transfers the toner image to the intermediate transfer device 20, and a drum cleaning device 16 that removes and cleans up adhering materials, such as adhering toner, that remain on the image holding surface of the photoconductor drum 11 after the primary transfer.

The photoconductor drum 11 is obtained by forming an image holding surface having a photoconductive layer (a photosensitive layer) formed of a photoconductor material on a peripheral surface of a cylindrical or columnar substrate to be grounded. The photoconductor drum 11 is supported so as to rotate in a direction indicated by an arrow A by transmitting a driving force from a driving device (not shown).

As shown in FIG. 2, the charging device 12 according to the first exemplary embodiment includes a charging roller 121 as an example of a contact charger that is disposed in contact with the photoconductor drum 11, and a cleaning roller 122 as an example of a cleaner that cleans a surface of the charging roller 121. A charging bias voltage is supplied to the charging device 12. When the developing device 14 performs inversion development, a voltage or current having the same polarity as a charging polarity of a toner supplied from the developing device 14 is supplied as a charging voltage. A configuration of the charging device 12 will be described in detail below.

As shown in FIG. 1, the exposure device 13 irradiates the peripheral surface of the charged photoconductor drum 11 with laser light LB that is generated according to image information input to the image forming apparatus 1, to form an electrostatic latent image. When a latent image is to be formed, image information (an image signal) input the image forming apparatus 1 by an optional unit is transmitted to the exposure device 13. As the exposure device 13, the following device may be used. That is, the device includes an LED print head that forms an electrostatic latent image by irradiating the photoconductor drum 11 with light using LEDs as plural light emitting elements arranged along an axial direction of the photoconductor drum 11.

As shown in FIG. 2, each of the developing devices 14 (Y, M, C, K) includes a developing roller 141 that holds a developer 4 inside a housing 140 formed with an opening and an accommodating chamber for the developer 4 and transports the developer 4 to a developing region facing the photoconductor drum 11, agitation transport members 142 and 143 such as a screw augers that transport the developer 4 to pass through the developing roller 141 while agitating the developer 4, and a layer thickness regulating member 144 that regulates an amount of the developer 4 (a layer thickness) held by the developing roller 141. A developing voltage is supplied to the developing device 14 (specifically, between the developing roller 141 and the photoconductor drum 11) from a power supply device (not shown). The developing roller 141 and the agitation transport members 142 and 143 are rotated in a predetermined direction by receiving a driving force form a driving device (not shown). Further, as the developer 4 (Y, M, C, K) of the four colors, a two-component developer containing a non-magnetic toner and a magnetic carrier is used.

As shown in FIGS. 1 and 2, the primary transfer device 15 is a contact transfer device including a primary transfer roller that rotates and is in contact with the peripheral surface of the photoconductor drum 11 via an intermediate transfer belt 21 at the primary transfer position T1. A primary transfer voltage is supplied to the primary transfer device 15. As the primary transfer voltage, a DC voltage having a polarity opposite to a charging polarity of the toner is supplied from a power supply device (not shown).

As shown in FIG. 2, the drum cleaning device 16 includes a cleaning blade 161 that is disposed inside a container-shaped main body 160 and removes and cleans up adhering materials such as residual toner, and a delivery member 162 such as a screw auger that collects the adhering materials such as the toner removed by the cleaning blade 161 and transports the collected materials to a collection system (not shown).

As shown in FIG. 1, the intermediate transfer device 20 is disposed at a position below each image forming device 10 (Y, M, C, K). The intermediate transfer device 20 includes: the intermediate transfer belt 21, as an example of an intermediate transfer body, that circulates in a direction indicated by an arrow B while passing through the primary transfer position T1 between the photoconductor drum 11 and the primary transfer device 15 (the primary transfer roller); plural belt support rollers 22 to 27 that hold the intermediate transfer belt 21 in a desired state from an inner periphery of the intermediate transfer belt 21 and support the intermediate transfer belt 21 so as to be capable of circulating; a secondary transfer device 30 that is disposed on an outer peripheral surface (an image holding surface) side of the intermediate transfer belt 21 supported by the belt support roller 26 and secondarily transfers the toner images on the intermediate transfer belt 21 to the recording sheet 5; and a belt cleaning device 28 that removes and cleans up adhering materials such as toner and paper dust remaining and adhering on the outer peripheral surface of the intermediate transfer belt 21 after passing through the secondary transfer device 30.

As the intermediate transfer belt 21, for example, an endless belt formed of a material in which a resistance adjusting agent such as carbon black is dispersed in a synthetic resin such as a polyimide resin or a polyamide resin is used. The belt support roller 22 is constituted as a driving roller; the belt support roller 23 is constituted as a lifting roller that holds a running position of the intermediate transfer belt 21; the belt support roller 24 is constituted as a tension applying roller; the belt support roller 25 is constituted as a driven roller that holds the intermediate transfer belt 21; the belt support roller 26 is constituted as a secondary transfer backup roller; and the belt support roller 27 is constituted as a support roller for the belt cleaning device 28.

As shown in FIG. 1, the secondary transfer device 30 includes a secondary transfer roller 31 that rotates at the secondary transfer position T2 which is an outer peripheral surface portion of the intermediate transfer belt 21 supported by the belt support roller 26 of the intermediate transfer device 20. The secondary transfer roller 31 or the belt support roller 26 of the intermediate transfer device 20 is supplied with a DC voltage having a polarity opposite to or the same as the charging polarity of the toner, as a secondary transfer voltage. Reference numeral 29 in FIG. 1 denotes a bias applying roller that applies a secondary transfer bias voltage to the belt support roller 26.

The fixing device 40 includes a roller-type or a belt-type heating rotating body 41 that is heated by a heater (a heat source) so that a surface temperature is maintained at a predetermined temperature, a roller-type or a belt-type pressurizing rotating body 42 that rotates in contact with the heating rotating body 41 at a predetermined pressure, and the like. In the fixing device 40, a contact portion where the heating rotating body 41 and the pressurizing rotating body 42 are in contact with each other is a fixing processor that performs fixing processing (heating and pressurizing).

The sheet feeding device 50 is disposed at a position below the intermediate transfer device 20. The sheet feeding device 50 includes a single (or plural) sheet accommodating body 51 that accommodates the recording sheets 5 of a desired size and type, and a delivery device 52 that delivers the recording sheets 5 one by one from the sheet accommodating body 51. The sheet accommodating body 51 is attached, for example, so as to be able to be pulled out to the front of the apparatus main body 1*a* (a side surface that a user faces during operation).

Examples of the recording sheet 5 include thin paper such as plain paper and tracing paper used for electrophotographic copying machines and printers, and an OHP sheet formed by a transparent film-shaped medium formed of a synthetic resin (such as PET). In order to further improve smoothness of an image surface after fixing, a surface of the recording sheet 5 may be as smooth as possible. For example, so-called thick paper having a relatively large basis weight such as coated paper obtained by coating a surface of plain paper with resin or the like, or art paper for printing may be used.

Plural (or a single) sheet transport roller pairs 53 to 56 that transport the recording sheet 5 delivered from the sheet feeding device 50 to the secondary transfer position T2 and a sheet feeding transport path 57 provided with a transport guide member (not shown) are provided between the sheet feeding device 50 and the secondary transfer device 30. The sheet transport roller pair 56 disposed immediately before the secondary transfer position T2 in the sheet feeding transport path 57 is constituted as, for example, a roller (a registration roller) that adjusts a transport timing of the recording sheet 5.

A sheet transport path 61 including plural (or a single) sheet transport belts 58 to 60 that transport the recording sheet 5 delivered from the secondary transfer device 30 to the fixing device 40 is provided between the secondary transfer device 30 and the fixing device 40.

A discharge transport path 62 including a sheet discharge roller (not shown) for discharging the recording sheet 5 onto which a toner image is fixed by the fixing device 40 to a sheet discharger (not shown) disposed on a side surface of the apparatus main body 1*a* is provided downstream of the fixing device 40.

In FIG. 1, reference numeral 100 denotes a control device as an example of a controller that integrally controls an operation of the image forming apparatus 1. The control device 100 includes a central processing unit (CPU), a read only memory (ROM), a random access memory (RAM), a bus connecting the CPU and the ROM, a communication interface, and the like.

Image Carrying Unit

Figure 3:
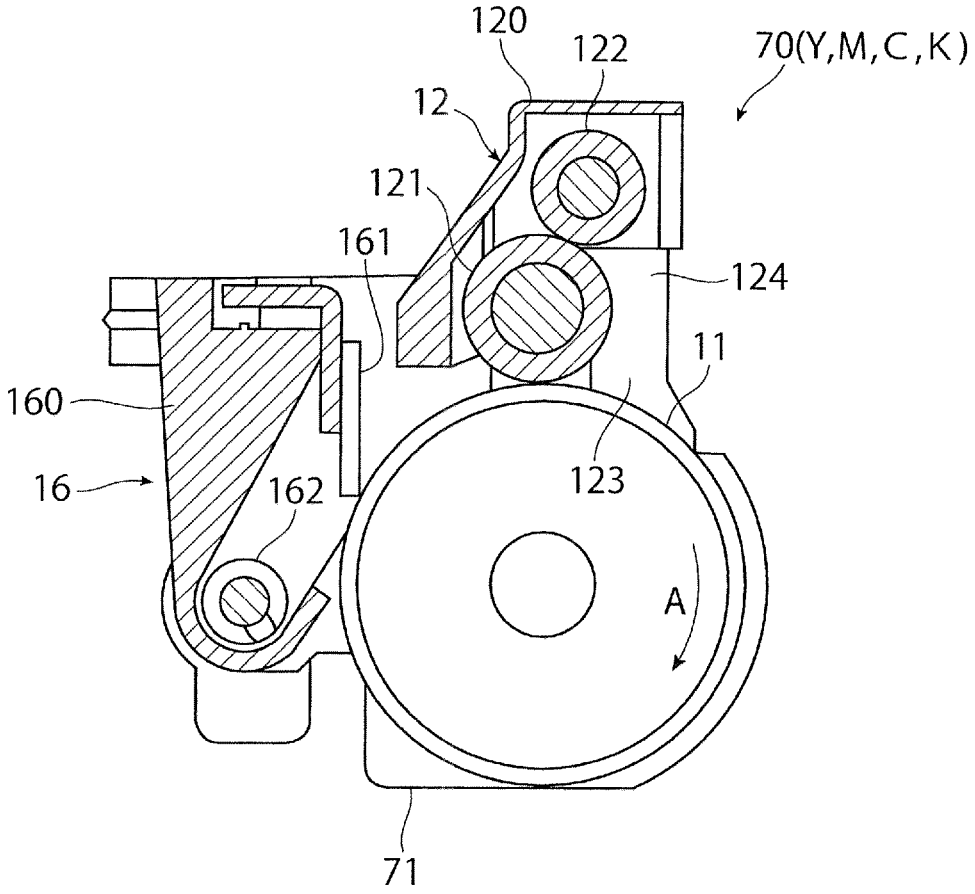
FIG. 3 is a cross-sectional view of the image carrying unit according to the first exemplary embodiment of the present disclosure.
Figure 4:
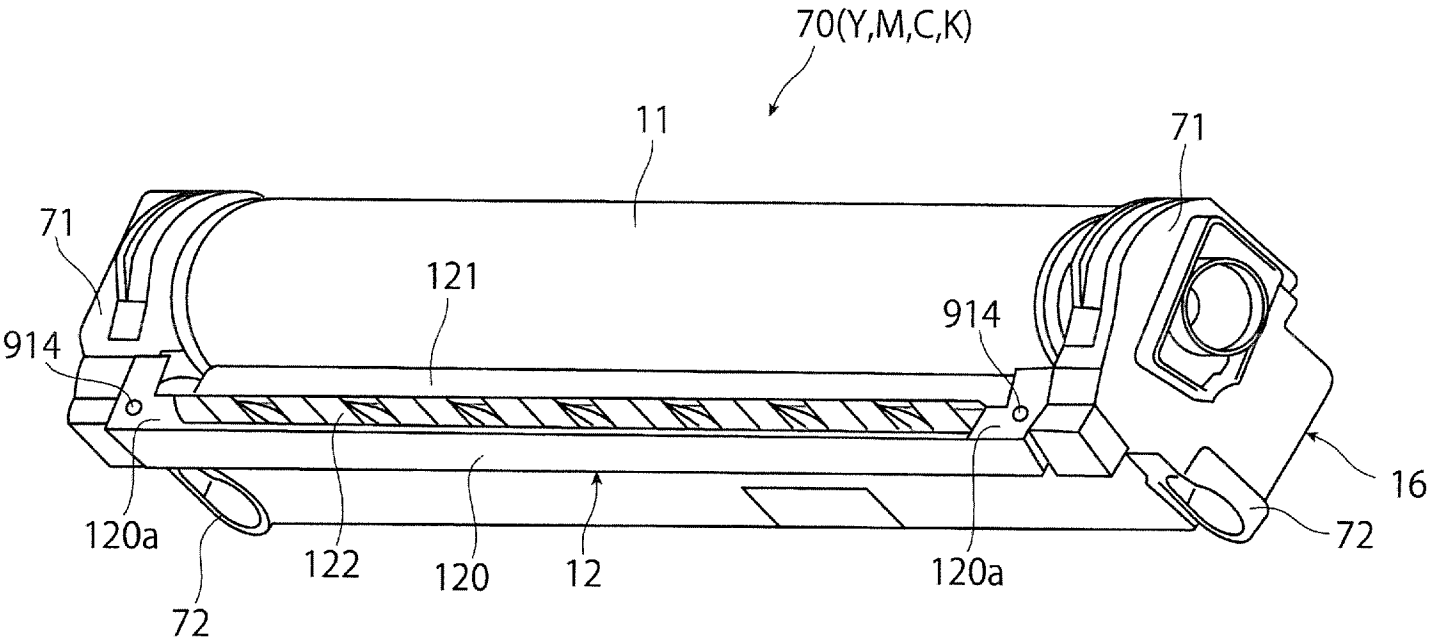
FIG. 4 is a perspective view of the image carrying unit according to the first exemplary embodiment of the present disclosure.

In the first exemplary embodiment, in each of the image forming devices 10 (Y, M, C, K) of yellow (Y), magenta (M), cyan (C), and black (K), the photoconductor drum 11 and at least the charging device 12 disposed around the photoconductor drum 11 integrally constitute an image carrying unit 70. As shown in FIGS. 3 and 4, the image carrying unit 70 (Y, M, C, K) includes the photoconductor drum 11, the charging device 12, and the drum cleaning device 16. Both end portions of the photoconductor drum 11 along an axial direction thereof are rotatably supported by a unit main body 71. The charging roller 121 of the charging device 12 and the cleaning blade 161 of the drum cleaning device 16 are integrally attached to the unit main body 71 such that the charging roller 121 is in contact with the peripheral surface of the photoconductor drum 11 and the cleaning blade 161 abuts against the peripheral surface of the photoconductor drum 111. The image carrying units 70 (Y, M, C, K) of respective the image forming devices 10 (Y, M, C, K) of yellow (Y), magenta (M), cyan (C), and black (K) are individually detachable from the apparatus main body 1*a* of the image forming apparatus 1. Since each image carrying unit 70 (Y, M, C, K) does not include the developing device 14, the developing devices 14 of the image forming devices 10 (Y, M, C, K) of yellow (Y), magenta (M), cyan (C), and black (K) have the same configuration. In FIG. 4, reference numeral 72 denotes a support portion that is supported by a user with a finger when the image carrying unit 70 (Y, M, C, K) is attached to or detached from the apparatus main body 1*a* of the image forming apparatus 1.

In order to prevent the photoconductor drum 11 from being exposed to natural light, a shielding member (not shown) covering the outer peripheral surface of the photoconductor drum 11 is detachably provided in the image carrying unit 70, as will be described below. The shielding member (not shown) is removed when the image carrying unit 70 is mounted on the apparatus main body 1*a* of the image forming apparatus 1.

The image carrying unit 70 is not limited to one including the photoconductor drum 11, the charging device 12, and the drum cleaning device 16. The image carrying unit 70 may include the photoconductor drum 11, the charging device 12, the developing device 14, and the drum cleaning device 16.

Basic Operation of Image Forming Apparatus

A basic image forming operation of the image forming apparatus 1 will be described below.

Here, an image forming operation when forming a full-color image with a combination of toner images of four colors (Y, M, C, K) by using the four image forming devices 10 (Y, M, C, K) will be described. An image forming operation when one or more of the four image forming devices 10 (Y, M, C, K) is used to form an image that is a toner image of a single color or a combination of toner images of plural colors is also basically the same.

When receiving instruction information indicating a request for image forming operation (printing), the image forming apparatus 1 starts the four image forming devices 10 (Y, M, C, K), the intermediate transfer device 20, the secondary transfer device 30, the fixing device 40, and the like under the control of the control device 100.

Then, in each image forming device 10 (Y, M, C, K), first, the photoconductor drum 11 rotates in the direction indicated by the arrow A, and the charging device 12 charges the surface of each photoconductor drum 11 to a predetermined potential having a predetermined polarity (specifically, a negative polarity in the first exemplary embodiment). Subsequently, the exposure device 13 irradiates the surface of the charged photoconductor drum 11 with light that is emitted based on an image signal obtained by converting image information input to the image forming apparatus 1 into each color component (Y, M, C, K), and forms an electrostatic latent image of each color component having a predetermined potential difference on the surface of the photoconductor drum 11.

Subsequently, each developing device 14 (Y, M, C, K) supplies a toner of a corresponding color (Y, M, C, K) charged to a predetermined polarity (specifically, a negative polarity) to the electrostatic latent image of the corresponding color component formed on the photoconductor drum 11 to cause the toner of the corresponding color to electrostatically adhere to the electrostatic latent image of the corresponding color component, for development. The development visualizes the electrostatic latent images of the color components formed on the photoconductor drums 11 into the toner images of the four colors (Y, M, C, K) developed with the toners of the corresponding colors.

Subsequently, when the toner images of the respective colors formed on the photoconductor drums 11 of the image forming devices 10 (Y, M, C, K) are transported to the primary transfer positions T1, the primary transfer devices 15 primarily transfer the toner images so as to sequentially superimpose the toner images of the respective colors on the intermediate transfer belt 21 of the intermediate transfer device 20 that rotates in the direction indicated by the arrow B.

Further, in each image forming device 10 (Y, M, C, K) that completes the primary transfer, the drum cleaning device 16 scrapes off the adhering materials to remove the adhering materials and cleans the surface of the photoconductor drum 11. Accordingly, each image forming device 10 (Y, M, C, K) is ready to form a next image forming operation.

Subsequently, the intermediate transfer device 20 holds and transports the primarily transferred toner image to the secondary transfer position T2 by the rotation of the intermediate transfer belt 21. The sheet feeding device 50 delivers the recording sheet 5 to the sheet feeding transport path 57 in accordance with the image forming operation. On the sheet feeding transport path 57, the sheet transport roller pair 56 serving as a registration roller delivers and supplies the recording sheet 5 to the secondary transfer position T2 in accordance with a transfer timing.

At the secondary transfer position T2, the secondary transfer roller 31 secondarily transfers the toner images on the intermediate transfer belt 21 to the recording sheet 5 at once. In the intermediate transfer device 20 after the completion of the secondary transfer, the belt cleaning device 28 removes and cleans adhering materials such as toner remaining on the surface of the intermediate transfer belt 21 after the secondary transfer.

Subsequently, the recording sheet 5 on which the toner image is secondarily transferred is separated from the intermediate transfer belt 21 and the secondary transfer roller 31 and then transported to the fixing device 40 by the three sheet transport belts 58 to 60. In the fixing device 40, by introducing and passing the recording sheet 5 after the secondary transfer to and through the contact portion between the rotating heating rotating body 41 and the rotating pressurizing rotating body 42, the fixing processing (heating and pressurizing) is performed to fix an unfixed toner image to the recording sheet 5. After the fixing is completed, the recording sheet 5 is discharged to, for example, a discharge accommodating unit (not shown) provided on the side surface of the image forming apparatus 1 by a sheet discharge roller (not shown) via the discharge transport path 62.

By the above operation, a full-color image formed by combining toner images including four colors of toner T (Y, M, C, K) is output.

Configuration of Charging Device

FIGS. 3 and 4 illustrate the image carrying unit including the charging device according to the first exemplary embodiment.

As shown in FIGS. 3 and 4, the charging device 12 includes a main body 120 that accommodates the charging roller 121 and the cleaning roller 122. The main body 120 of the charging device 12 is constituted as a box having a substantially rectangular parallelepiped shape having a length that extends over substantially the entire length of the photoconductor drum 11. The main body 120 has openings 123 and 124 on a surface facing the photoconductor drum 11 and a side surface, respectively. As shown in FIG. 4, the main body 120 of the charging device 12 is integrally or separately attached to the unit main body 71 of the image carrying unit 70.

Figure 5A:
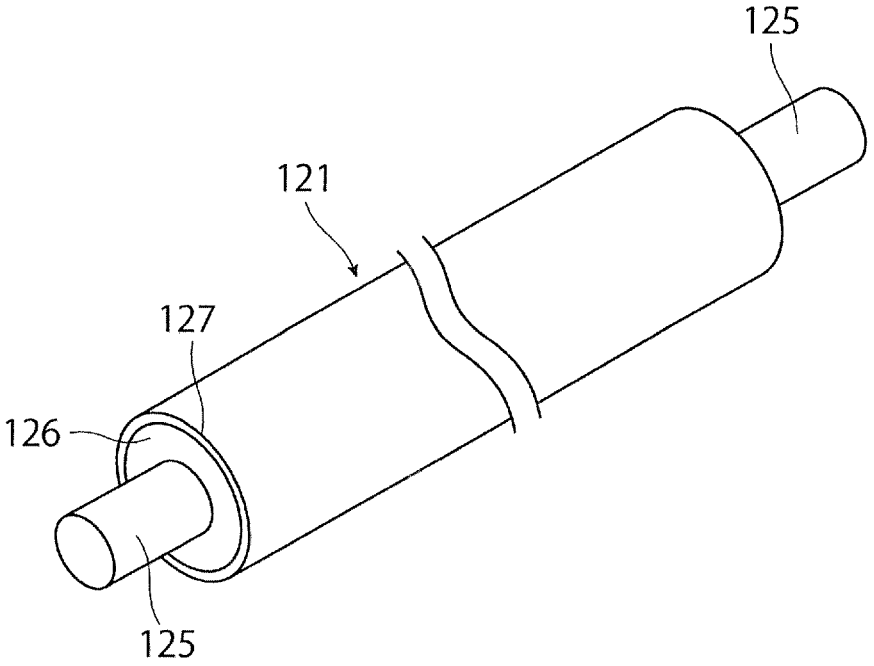
FIGS. 5A and 5B are views illustrating a configuration of a charging roller.
Figure 5B:
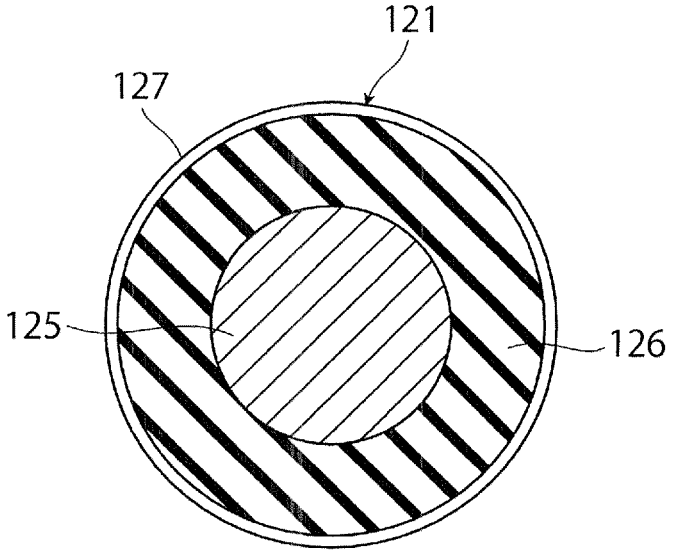

As shown in FIGS. 5A and 5B, the charging roller 121 of the charging device 12 is formed in a cylindrical shape. The charging roller 121 includes a cylindrical core bar 125 formed of a metal such as stainless steel or iron, a semiconductive elastic body layer 126 that has a predetermined thickness, is coated on an outer periphery of the core bar 125, and is imparted with conductivity, and a surface layer 127 thinly coated on a surface of the elastic body layer 126. The core bar 125 protrudes from both end portions along an axial direction of the charging roller 121 and serves as a rotation shaft. A DC voltage or a DC voltage superimposed with an AC voltage is applied as a charging bias voltage to the core bar 125 of the charging roller 121 from a high voltage power supply (not shown).

Figure 6:
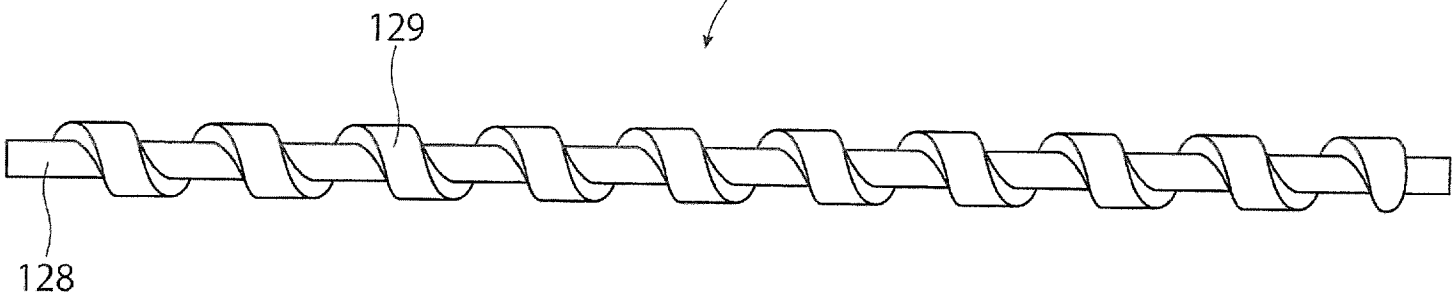
FIG. 6 is a view illustrating a configuration of a cleaning roller.

As shown in FIG. 6, the cleaning roller 122 is constituted by spirally winding a cleaning member 129 on an outer periphery of a cylindrical core bar 128 at a predetermined pitch via an adhesive or glue such as a double-sided tape. The cleaning member 129 is formed of a strip-shaped sponge having a predetermined thickness. The cylindrical core bar 128 is formed of a metal such as stainless steel. The core bar 128 protrudes from both end portions in an axial direction of the cleaning roller 122. The core bar 128 serves as a rotation shaft. The core bar 128 of the cleaning roller 122 has an outer diameter smaller than that of the core bar 125 of the charging roller 121. As a matter of course, the cleaning roller 122 may be provided with the cleaning member 129 formed in a cylindrical shape, instead of that the cleaning member 129 which is formed of the sponge and is spirally wound on the outer periphery of the cylindrical core 128.

Figure 7:
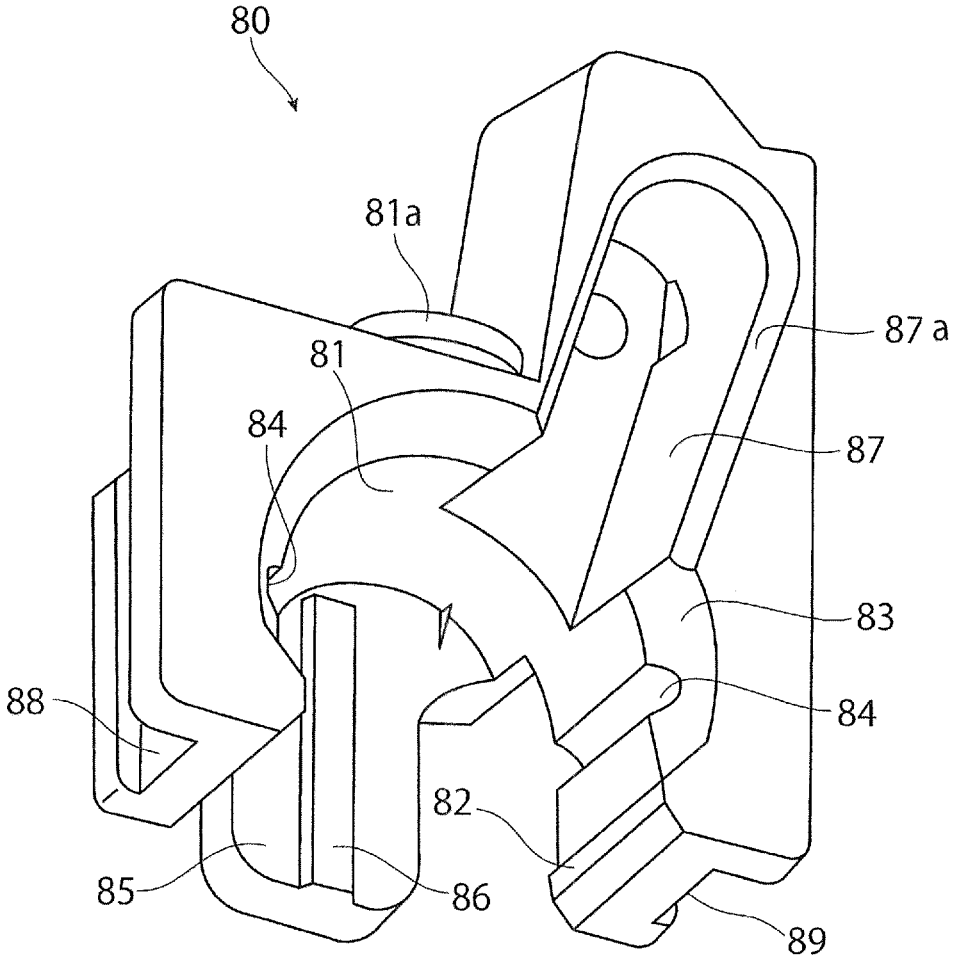
FIG. 7 is a perspective view of a bearing member.

As shown in FIG. 7, the charging roller 121 and the cleaning roller 122 are rotatably supported by bearing members 80 at both end portions of the core bars 125 and 128 serving as the rotation shafts. The bearing member 80 is integrally formed of, for example, a synthetic resin having high slidability such as polytetrafluoroethylene (PTFE), perfluoroalkoxy alkane (PFA), or an ethylene-tetrafluoroethylene copolymer (ETFE).

The bearing member 80 includes a first bearing portion 81 that rotatably supports the core bar 125 of the charging roller 121 at a central portion thereof. The first bearing portion 81 is formed in a substantially cylindrical shape having an opening 82 at a lower end portion thereof. The first bearing portion 81 includes an inclined surface 83 for facilitating supporting the core bar 125 of the charging roller 121 at an end edge of an inner surface thereof along the axial direction. An opening width of the opening 82 of the first bearing portion 81 is smaller than an outer diameter of the core bar 125 of the charging roller 121. The first bearing portion 81 does not have a circular cross-sectional shape along the outer diameter of the core bar 125 of the charging roller 121, but have an oval shape that is longer in a direction intersecting the axial direction (vertical direction) than the outer diameter of the core bar 125. Therefore, the core bar 125 of the charging roller 121 is supported inside the first bearing portion 81 so as to be movable in directions in which the charging roller 121 comes into contact with and is separated from the surface of the photoconductor drum 11. Further, grooves 84 are formed in the first bearing portion 81 along an axial direction in order to reduce sliding resistance with the core bar 125 of the charging roller 121. The grooves 84 are formed in both end surfaces extending along a horizontal direction intersecting a vertical direction of an inner surface of the first bearing portion 81. A regulation plate portion 85 is provided at an end portion on a back side along the axial direction of the first bearing portion 81. The regulation plate portion 85 comes into contact with an end surface in the axial direction of the core bar 125 of the charging roller 121 to regulate a movement of the charging roller 121. A protrusion 86 is formed on an inner side surface of the regulation plate portion 85. The protrusion 86 extends along the vertical direction. The protrusion 86 reduces a contact area between the regulation plate portion 85 and the end surface in the axial direction of the core bar 125 of the charging roller 121.

The bearing member 80 includes a second bearing portion 87 that is disposed obliquely above the first bearing portion 81. The second bearing portion 87 rotatably supports the core bar 128 of the cleaning roller 122. The second bearing portion 87 is disposed along a straight line connecting a center of the core bar 125 of the charging roller 121 and a center of the core bar 128 of the cleaning roller 122. The second bearing portion 87 is formed in a groove shape having an opening width slightly larger than an outer diameter of the core bar 128 of the cleaning roller 122. The second bearing portion 87 has an inclined surface 87*a* at an end edge of an inner surface thereof along the axial direction, in order facilitate supporting the core bar 128 of the cleaning roller 122. The second bearing portion 87 is provided, for example, in communication with the first bearing portion 81. Alternatively, the second bearing portion 87 and the first bearing portion 81 may be partitioned by an outer peripheral wall of the first bearing portion 81.

Grooves 88 and 89 are formed in the bearing member 80 at both end portions along a width direction thereof. The grooves 88 and 89 extend along the direction in which the bearing member 80 comes into contact with and is separated from the photoconductor drum 11. The bearing member 80 is provided with a protrusion 81*a* on an upper end portion of the first bearing portion 81 in order to support one end of a coil spring 93. The coil spring 93 urges the charging roller 121 to a direction in which the charging roller 121 comes into contact with the surface of the photoconductor drum 11. The coil spring 93 is an example of an urging member.

Figure 8:
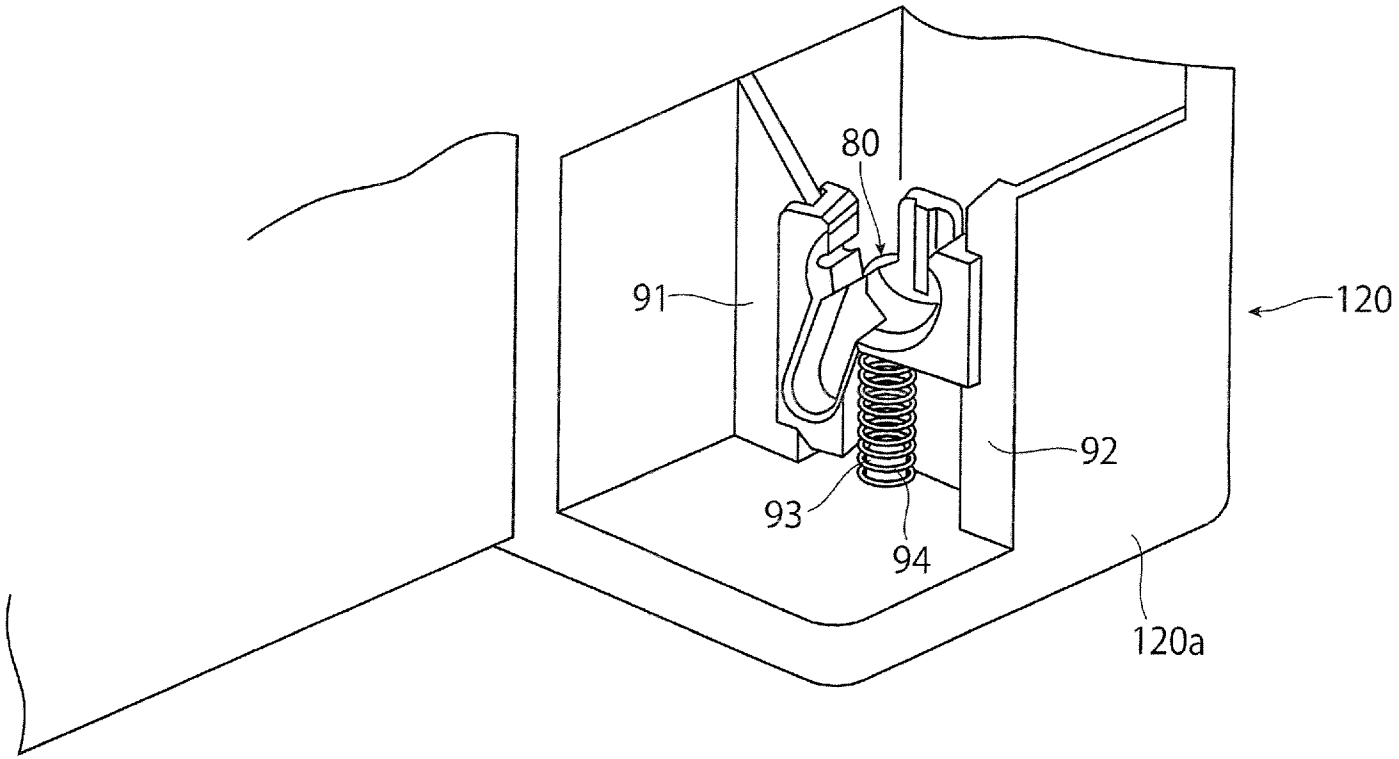
FIG. 8 is a perspective view of a part of the charging device according to the first exemplary embodiment of the present disclosure.

As shown in FIG. 8, the bearing members 80 are respectively mounted on shaft support portions 120*a* provided at both end portions in a longitudinal direction of the main body 120 of the charging device 12, so as to be movable along a direction in which the charging roller 121 come in contact with and separated from the photoconductor drum 11. The shaft support portion 120*a* of the main body 120 includes a pair of guide plates 91 and 92 that face each other via a predetermined gap along a horizontal direction. The guide plates 91 and 92 are slidably inserted into the grooves 88 and 89 provided on both sides of the bearing member 80. Thereby, the bearing member 80 is supported to be movable in the direction in which the charging roller 121 comes into contact with and separated from the photoconductor drum 11. A protrusion 94 is provided on an inner surface of the shaft support portion 120*a* of the main body 120. The protrusion supports the other end of the coil spring 93.

The charging roller 121 is driven and rotated with pressed against the surface of the photoconductor drum 11 with a predetermined pressing force by the coil spring 93. The cleaning roller 122 is driven and rotated with pressed against the surface of the charging roller 121 by its own weight.

As shown in FIGS. 3 and 4, the charging device 12 is disposed in with the charging roller 121 pressed against the surface of the photoconductor drum 11 with the predetermined pressing force. The cleaning roller 122 is disposed with pressed against the surface of the charging roller 121 by its own weight.

Therefore, when the image carrying unit 70 including the charging device 12 has not yet been used (for example, the image carrying unit 70 has been stored), and has been left for a long period of time with the charging roller 121 pressed against the surface of the photoconductor drum 11, the surface of the charging roller 121 deforms following a surface shape of the photoconductor drum 11. As a result, when the image carrying unit 70 is mounted on the apparatus main body 1*a* of the image forming apparatus 1 and starts to be used, a charging failure may occur due to the deformation of the surface of the charging roller 121.

Similarly, when the image carrying unit 70 including the charging device 12 has not yet been used (for example, the image carrying unit 70 has been stored) and has been left for a long period of time with the cleaning roller 122 pressed against the surface of the charging roller 121, the surface of the cleaning roller 122 deforms following a surface shape of the charging roller 121. As a result, when the image carrying unit 70 is mounted on the apparatus main body 1*a* of the image forming apparatus 1 and starts to be used, a charging failure may occur due to the deformation of the surface of the cleaning roller 122.

Therefore, the image carrying unit 70 including the charging device 12 according to the first exemplary embodiment includes a separating member 90. When the image carrying unit 70 has not yet been used, the separating member 90 separates the charging roller 121 from the surface of the photoconductor drum 11 and separates the cleaning roller 122 from the surface of the charging roller 121. The separating member 90 is an example of a separator.

Figure 9:
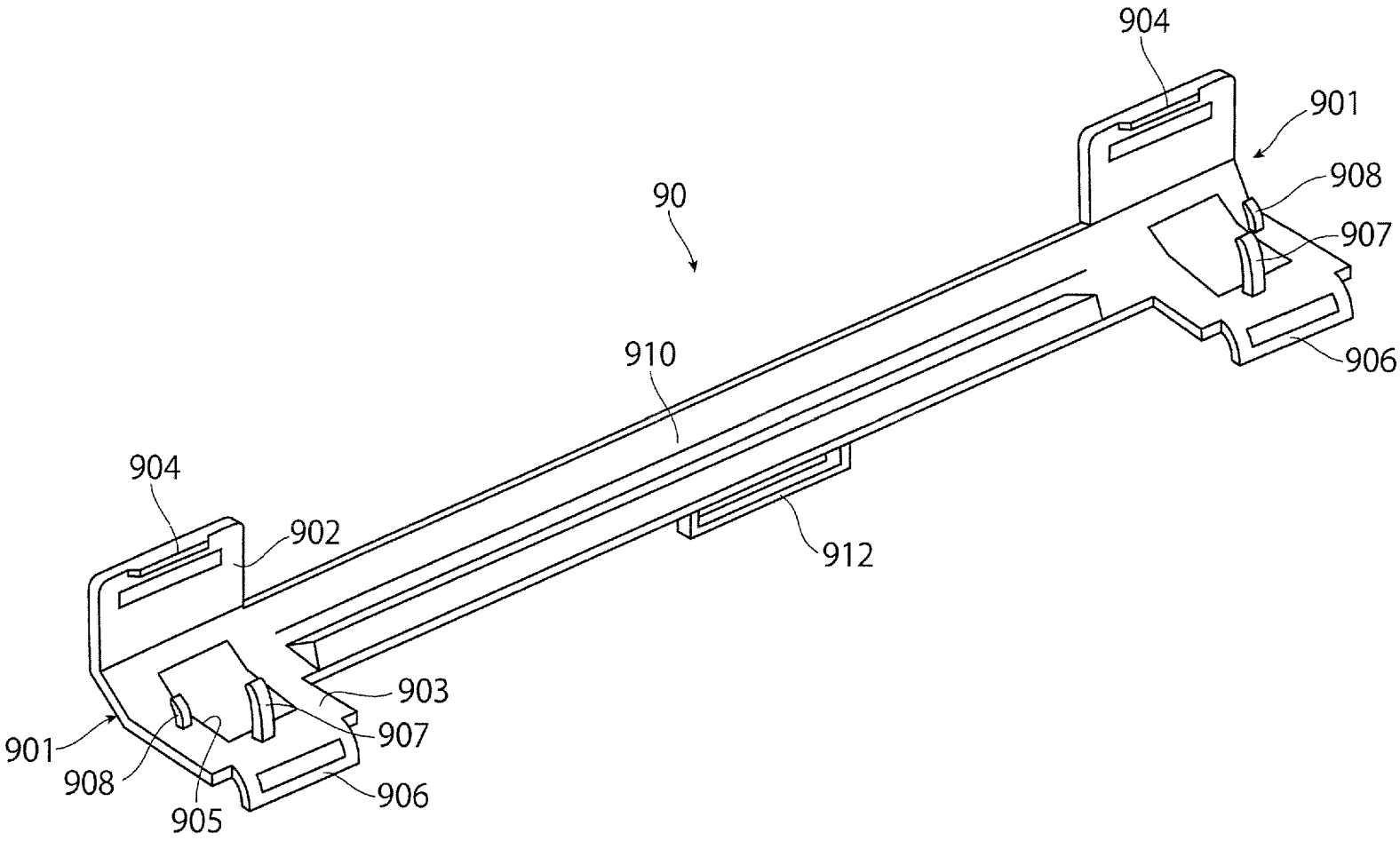
FIG. 9 is a perspective view of a separating member.

As shown in FIG. 9, the separating member 90 is formed in a long rod shape having a predetermined width. The separating member 90 is disposed along the main body 120 of the charging device 12. The separating member 90 includes separating portions 901 at both end portions in a longitudinal direction thereof. Each separating portion 901 is formed of a plate-shaped member and is bent into a substantially L-shape in a side view. The separating portion 901 corresponds to the shaft support portions 120*a* of the main body 120 of the charging device 12, respectively.

Figure 10:
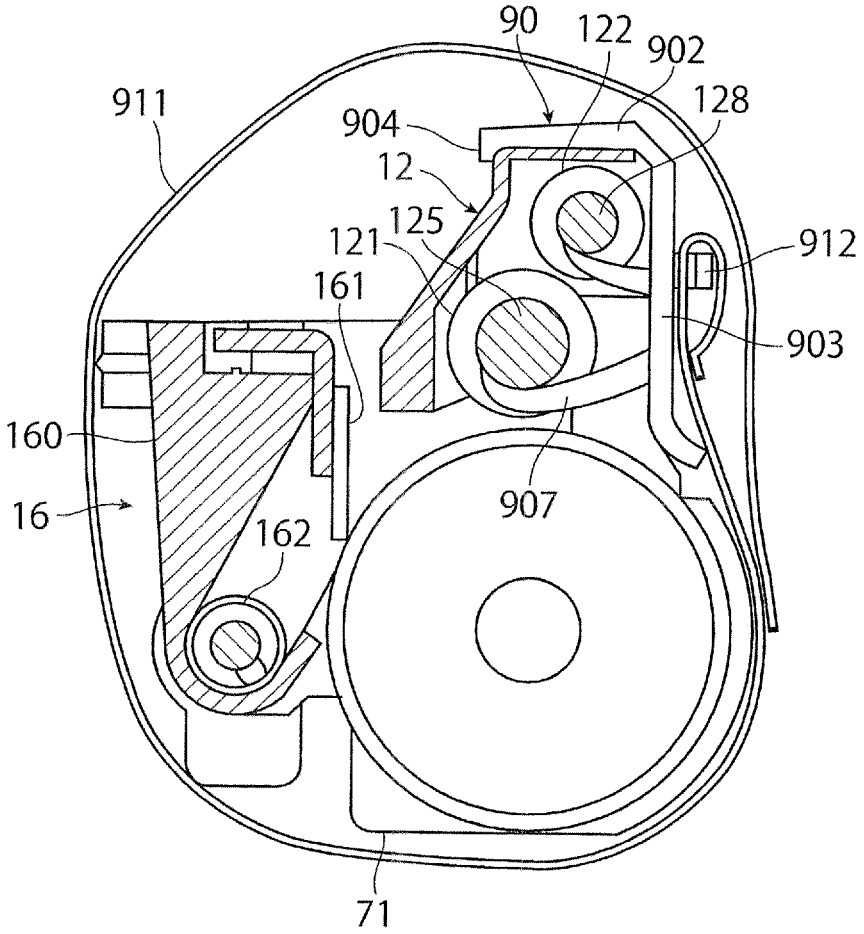
FIG. 10 is a cross-sectional view of the image carrying unit according to the first exemplary embodiment of the present disclosure.

The separating portion 901 of the separating member 90 integrally includes a first flat plate portion 902 and a second flat plate portion 903. The first flat plate portion 902 is to be mounted on an upper end surface of the shaft support portion 120*a* of the charging device 12. The second flat plate portion 903 intersects the first flat plate portion 902. The second flat plate portion 903 is to be mounted on a side surface of the shaft support portion 120*a* of the charging device 12. As shown in FIG. 10, the first flat plate portion 902 of the separating portion 901 is provided with an engagement piece 904 to be engaged with an end edge of the shaft support portion 120*a* of the charging device 12. The second flat plate portion 903 of the separating portion 901 is provided with an opening 905 that receives a protrusion protruding from the side surface of the shaft support portion 120*a* of the charging device 12. A handle portion 906 is formed at a tip end of the second flat plate portion 903 of the separating portion 901, for a user to handle with hands to elastically deform the second flat plate portion 903 when attaching or detaching the separating member 90 to or from the shaft support portion 120*a* of the charging device 12.

A first claw portion 907 and a second claw portion 908 are provided on an inner surface of the second flat plate portion 903 of the separating portion 901 of the separating member 90. The first claw portion 907 is brought into contact with the core bar 125 of the charging roller 121. The first claw portion 907 is an example of a first contact portion. The second claw portion 908 is brought into contact with the core bar 128 of the cleaning roller 122. The second claw portion 908 is an example of a second contact portion. The first claw portion 907 is disposed at a lower end portion of the opening 905 provided in the second flat plate portion 903 of the separating portion 901. The first claw portion 907 is formed in an elongated, curved protrusion shape. The first claw portion 907 protrudes toward the core bar 125 of the charging roller 121. The second claw portion 908 is disposed at an outer end portion of the opening 905 provided in the second flat plate portion 903 of the separating portion 901. The second claw portion 908 is formed in an elongated, curved protrusion shape. The second claw portion 908 protrudes toward the core bar 128 of the cleaning roller 122. The second claw portion 908 has a protruding length shorter than that of the first claw portion 907. As shown in FIG. 4, the second claw portion 908 is in contact with the core bar 128 of the cleaning roller 122 through an opening 914 opened in the shaft support portion 120*a* in the main body 120 of the charging device 12.

Figure 11:
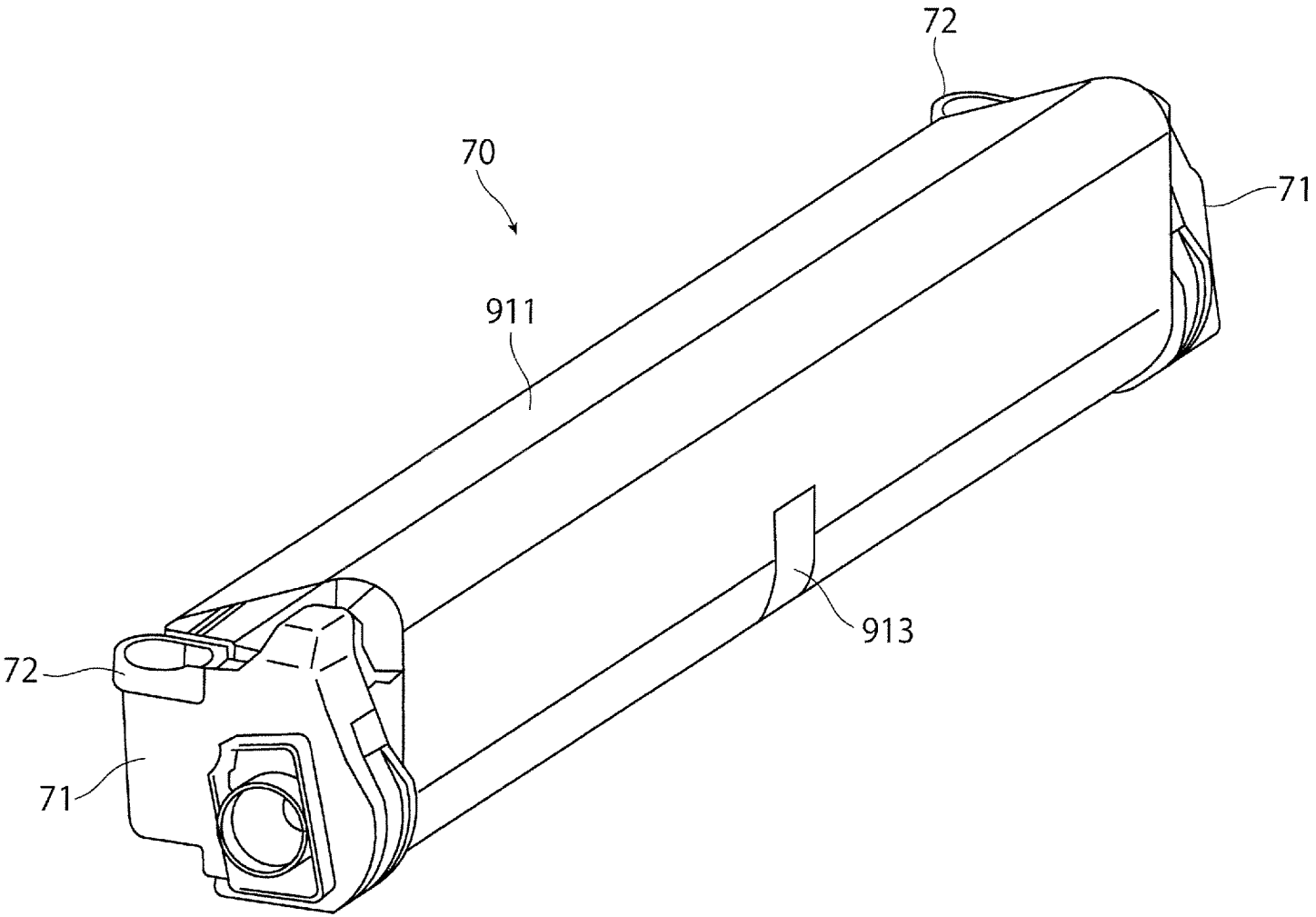
FIG. 11 is a perspective view of the image carrying unit according to the first exemplary embodiment of the present disclosure.

The separating member 90 is provided with an elongated, substantially flat connection portion 910 that connects the separating portions 901 at both end portions. As shown in FIGS. 10 and 11, a fixing portion 912 is provided at a central portion of the connection portion 910. The fixing portion 912 fixes a base end portion of a shielding member 911 to a surface on the second flat plate portion 903 side. The shielding member 911 is provided to protect the photoconductor drum 11 from being exposed. The shielding member 911 is formed of black paper having a rectangular shape. The shielding member 911 is fixed to an outer peripheral surface of the shielding member 911 with an adhesive tape 913 or the like with wound around an outer periphery of the photoconductor drum 11.

Action of Charging Device

In the following manner, the image carrying unit 70 including the charging device 12 according to the first exemplary embodiment prevents uneven charging due to the deformation of the cleaning roller 122 as compared with a case where the cleaning roller 122 is in contact with the charging roller 121 when the image carrying unit 70 has not yet been used.

When the image carrying unit 70 including the charging device 12 according to the first exemplary embodiment has not yet been used, the separating member 90 is mounted on the charging device 12 as shown in FIG. 10.

As shown in FIG. 10, a tip end of the first claw portion 907 of the separating portion 901 of the separating member 90 is brought into contact with the core bar 125 of the charging roller 121, so that the core bar 125 of the charging roller 121 is displaced to move the surface of the charging roller 121 to a position separated from the peripheral surface of the photoconductor drum 11. Similarly, a tip end of the second claw portion 908 of the separating portion 901 of the separating member 90 is brought into contact with the core bar 128 of the cleaning roller 122, so that the core bar 128 of the cleaning roller 122 is displaced to move the surface of the cleaning roller 122 to a position separated from a peripheral surface of the charging roller 121.

With this configuration, even when the image carrying unit 70 has not yet been used and has been left for a long period of time, the surface of the charging roller 121 does not come into contact with the photoconductor drum 11 and similarly the surface of the cleaning roller 122 does not come into contact with the charging roller 121.

Therefore, the image carrying unit 70 including the charging device 12 according to the first exemplary embodiment prevents uneven charging due to deformation of the cleaning roller 122 as compared with the case where the cleaning roller 122 is in contact with the charging roller 121 when the image carrying unit 70 has not yet been used.

Second Exemplary Embodiment

Figure 12:
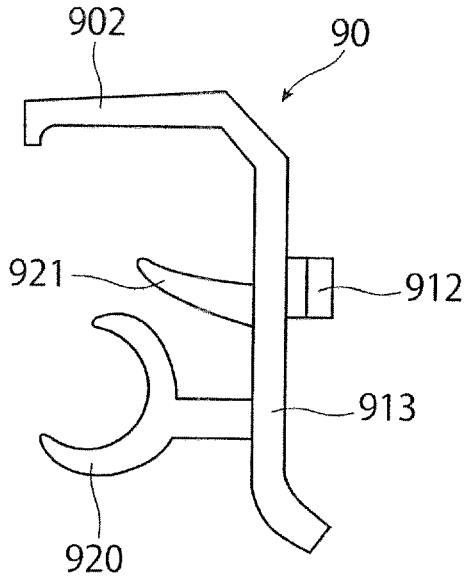
FIG. 12 is a view illustrating a separating member of a charging device according to a second exemplary embodiment of the present disclosure.

FIG. 12 illustrates a charging device according to a second exemplary embodiment. The charging device according to the second exemplary embodiment is configured as follow. That is, a separator includes a holder and a third contact portion. The holder holds a rotation shaft of a charger. The third contact portion is brought into contact with a rotation shaft of a cleaner. After the holder holds the rotation shaft of the charger, the third contact portion is brought into contact with the rotation shaft of the cleaner.

That is, as shown in FIG. 12, the image carrying unit 70 including the charging device 12 according to the second exemplary embodiment includes the separating member 90 that is mounted on the charging device 12. The separating member 90 includes a holder 920 and a third claw portion 921. The holder 920 is formed in a substantially C-shape following an outer diameter of the core bar 125 of the charging roller 121. The holder 920 holds the core bar 125 of the charging roller 121. The third claw portion 921 is brought into contact with the core bar 128 of the cleaning roller 122. The third claw portion 921 is an example of a third contact portion. After the holder 920 holds the core bar 125 of the charging roller 121, the third claw portion 921 is brought into contact with the core bar 128 of the cleaning roller 122.

Figure 13:
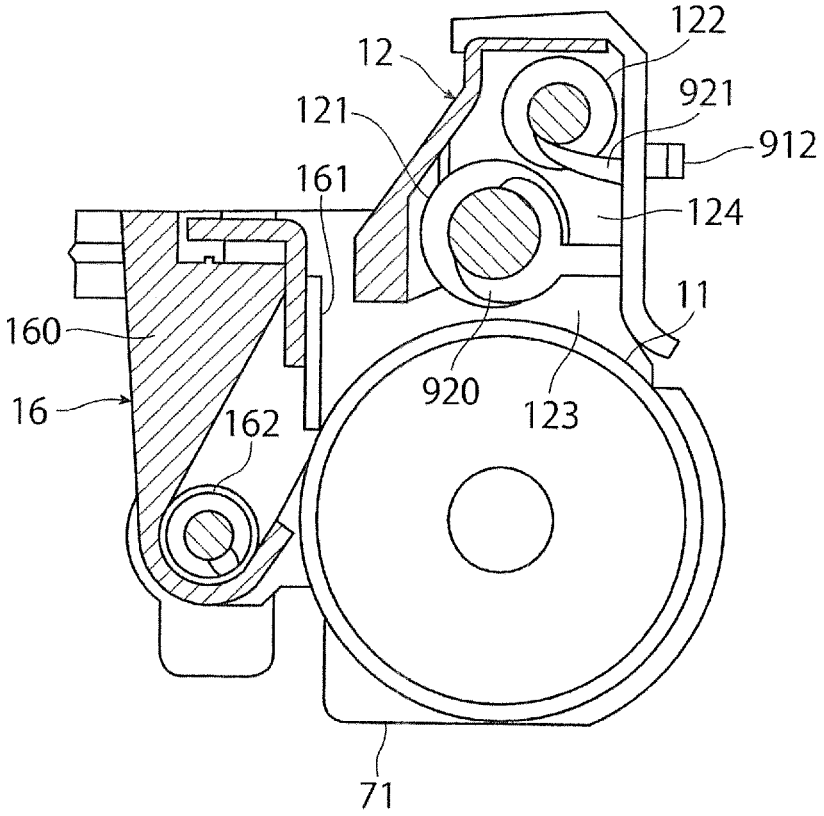
FIG. 13 is a cross-sectional view of an image carrying unit according to the second exemplary embodiment of the present disclosure.

As shown in FIG. 13, in the image carrying unit 70 including the charging device 12 according to the second exemplary embodiment, the holder 920 is configured to hold the core bar 125 of the charging roller 121. Therefore, the followings are surely prevented, that is, (i) the charging roller 121 comes into contact with the surface of the photoconductor drum 11 and (ii) during the storage, the charging roller 121 moves in a direction away from the photoconductor drum 11 due to a certain factor and comes into contact with a surface of the cleaning roller 122.

Other configurations and operations are the same as those of the above exemplary embodiment, and a description thereof is omitted.

The full-color image forming apparatus including the image forming devices 10 (Y, M, C, K) of yellow (Y), magenta (M), cyan (C), and black (K) is described as an image forming apparatus in the above exemplary embodiments. It is needless to say that the above disclosure is applicable to a monochrome image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charger configured to charge an image holding unit;

a cleaner configured to clean the charger; and a separator configured to, if the charging device has not yet been used, separate the charger from the image holding unit and separate the cleaner from the charger.

2. The charging device according to claim 1, wherein the separator comprises:

a first contact portion configured to be brought into contact with a rotation shaft of the charger; and a second contact portion configured to be brought into contact with a rotation shaft of the cleaner, and wherein the charging device is configured such that, after the second contact portion is brought into contact with the rotation shaft of the cleaner, the first contact portion is brought into contact with the rotation shaft of the charger.

3. The charging device according to claim 1, wherein the separator is configured to, if the charging device has not yet been used, fix a position of the charger and simultaneously separate the cleaner from the charger.

4. The charging device according to claim 3, wherein the separator comprises:

a holder configured to hold a rotation shaft of the charger, and a third contact portion configured to be brought into contact with a rotation shaft of the cleaner, and wherein the charging device is configured such that, after the holder holds the rotation shaft of the charger, the third contact portion is brought into contact with the rotation shaft of the cleaner.

5. An image carrying unit detachably mounted on an image forming apparatus main body, the image carrying unit comprising:

an image carrier on which an image may be formed; and a charger configured to charge the image carrier, wherein the charging device according to claim 1 is used as the charger.

6. An image forming apparatus comprising:

an image holding unit configured to hold an image; and a charger configured to charge the image holding unit, wherein the charging device according to claim 1 is used as the charger.

* * * * *